US008852062B2

(12) United States Patent
Dorsay

(10) Patent No.: US 8,852,062 B2
(45) Date of Patent: Oct. 7, 2014

(54) EXERCISE DEVICE AND METHOD

(76) Inventor: Douglas Dorsay, Sarasota, FL (US)

( * ) Notice: Subject to any disclaimer, the term of this patent is extended or adjusted under 35 U.S.C. 154(b) by 245 days.

(21) Appl. No.: 13/501,337

(22) PCT Filed: Oct. 15, 2010

(86) PCT No.: PCT/US2010/052873

§ 371 (c)(1),
(2), (4) Date: Apr. 11, 2012

(87) PCT Pub. No.: WO2011/047282

PCT Pub. Date: Apr. 21, 2011

(65) Prior Publication Data

US 2012/0202656 A1 Aug. 9, 2012

Related U.S. Application Data

(60) Provisional application No. 61/252,303, filed on Oct. 16, 2009.

(51) Int. Cl.
*A63B 21/02* (2006.01)
*A63B 24/00* (2006.01)

(Continued)

(52) U.S. Cl.
CPC ..... *A63B 23/12* (2013.01); *A63B 24/0075* (2013.01); *A63B 23/08* (2013.01);

(Continued)

(58) Field of Classification Search
CPC ..... A63B 21/0552; A63B 21/0557; A63B 21/154; A63B 21/00043; A63B 2023/006
USPC ..... 482/92, 131, 133, 135, 136, 121–126
See application file for complete search history.

(56) References Cited

U.S. PATENT DOCUMENTS 4,519,605 A 5/1985 Leland
4,836,535 A 6/1989 Pearson (Continued)

FOREIGN PATENT DOCUMENTS

JP 4072182 4/2008
WO 2008045482 4/2008

OTHER PUBLICATIONS

ISR International Search Report for dated Jun. 3, 2011 for PCT/US2010/052873.

(Continued)

*Primary Examiner* — Loan H Thanh
*Assistant Examiner* — Megan Anderson
(74) *Attorney, Agent, or Firm* — Fleit Gibbons Gutman Bongini & Bianco PL; Gary S. Winer; Paul D. Bianco

(57) ABSTRACT

An exercise device includes a pivot frame rotatably mounted to a base support along a pivot axis, wherein a pivot brace forms a rotatable connection between the pivot frame and the base support. The pivot frame is formed with two pivot frame ends which are disposed at an angle with respect to a location of the pivot brace. A user position a portion of his body between the ends. The pivot frame includes a plurality of pulley sheaves or wheels operative to transmit energy from the user through one or more cables. One or more handles or grips, each grasped by the hand of a user, are connected to the cable, which extends in substantially opposite directions from the grip. Resistance means comprises a housing connected to the pivot frame operable to rotatably receive a spool to take-up the cable, and which imposes a resistance to the free rotation of the spool, the resistance imparted to the user for therapeutic benefit.

20 Claims, 7 Drawing Sheets

(51) Int. Cl.

| | |
|---|---|
| ***A63B 21/16*** | (2006.01) |
| ***A63B 21/00*** | (2006.01) |
| ***A63B 23/12*** | (2006.01) |
| *A63B 23/08* | (2006.01) |
| *A63B 71/00* | (2006.01) |
| *A63B 23/10* | (2006.01) |
| *A63B 21/055* | (2006.01) |
| *A63B 21/04* | (2006.01) |
| *A63B 21/005* | (2006.01) |
| *A63B 21/008* | (2006.01) |
| *A63B 23/02* | (2006.01) |
| *A63B 23/04* | (2006.01) |
| *A63B 22/00* | (2006.01) |

(52) U.S. Cl.

CPC ... *A63B 2220/803* (2013.01); *A63B 2071/0018* (2013.01); *A63B 24/0087* (2013.01); *A63B 23/10* (2013.01); *A63B 2230/06* (2013.01); *A63B 21/0552* (2013.01); *A63B 2024/0012* (2013.01); *A63B 2208/02* (2013.01); *A63B 2230/75* (2013.01); *A63B 21/0414* (2013.01); *A63B 2230/42* (2013.01); *A63B 2021/0055* (2013.01); *A63B 2230/20* (2013.01); *A63B 21/16* (2013.01); *A63B 21/008* (2013.01); *A63B 23/0233* (2013.01); *A63B 21/156* (2013.01); *A63B 23/0405* (2013.01); *A63B 21/04* (2013.01); *A63B 21/005* (2013.01); *A63B 22/0023* (2013.01)

USPC ..... 482/121

(56) References Cited

U.S. PATENT DOCUMENTS

| | | | | |
|---|---|---|---|---|
| 5,013,035 | A | 5/1991 | Nathaniel | |
| 5,040,785 | A | 8/1991 | Charnitski | |
| 5,044,629 | A * | 9/1991 | Ryan et al. | 482/101 |
| 5,466,204 | A | 11/1995 | Nearing | |
| 5,647,823 | A | 7/1997 | Spence | |
| 5,688,210 | A | 11/1997 | Chou | |
| 5,800,321 | A | 9/1998 | Webber | |
| 5,807,219 | A | 9/1998 | Webber | |
| 5,916,063 | A | 6/1999 | Alessandri | |
| 5,928,117 | A * | 7/1999 | Vittone et al. | 482/99 |
| 5,931,763 | A | 8/1999 | Alessandri | |
| 5,997,448 | A | 12/1999 | Duba | |
| 6,036,624 | A | 3/2000 | Cascini | |
| 6,132,347 | A | 10/2000 | Alessandri | |
| 6,174,265 | B1 | 1/2001 | Alessandri | |
| 6,328,676 | B1 | 12/2001 | Alessandri | |
| 6,334,836 | B1 | 1/2002 | Segasby | |
| 6,409,631 | B1 | 6/2002 | Alessandri | |
| 6,443,877 | B1 | 9/2002 | Hoecht | |
| 6,468,189 | B2 | 10/2002 | Alessandri | |
| 6,494,811 | B1 | 12/2002 | Alessandri | |
| 6,514,199 | B1 | 2/2003 | Alessandri | |
| 6,595,903 | B2 | 7/2003 | Nerio | |
| 6,616,578 | B2 | 9/2003 | Alessandri | |
| 7,001,312 | B2 | 2/2006 | Alessandri | |
| 7,850,578 | B2 * | 12/2010 | Balaker et al. | 482/70 |
| 7,892,156 | B2 * | 2/2011 | Marcantonio | 482/128 |
| 2008/0058175 | A1 | 3/2008 | Gautier | |
| 2008/0090708 | A1 | 4/2008 | Balaker | |
| 2011/0306479 | A1 * | 12/2011 | Pierce et al. | 482/139 |

OTHER PUBLICATIONS

IPR WO2011/047282 published Apr. 21, 2011 for PCT/US2010/052873 filed Oct. 15, 2010.

European Patent Application No. 10824177.9, regional phase of PCT/US2010/052873.

Supplemental Search Report dated Apr. 30, 2013 for EP10824177.9 filed Apr. 11, 2012.

International Preliminary Report on Patentability dated Apr. 17, 2012 for PCT/US2010/052873 filed Oct. 15, 2010.

Written Opinion dated May 26, 2011 for PCT/US2010/052873 filed Oct. 15, 2010.

* cited by examiner

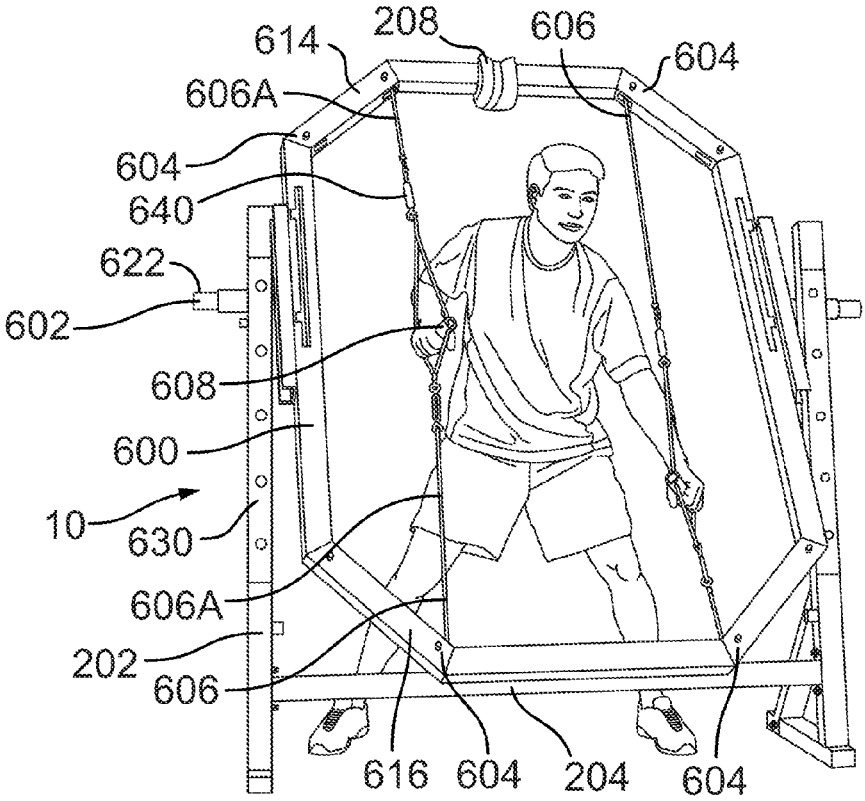
FIG. 1
FIG. 2
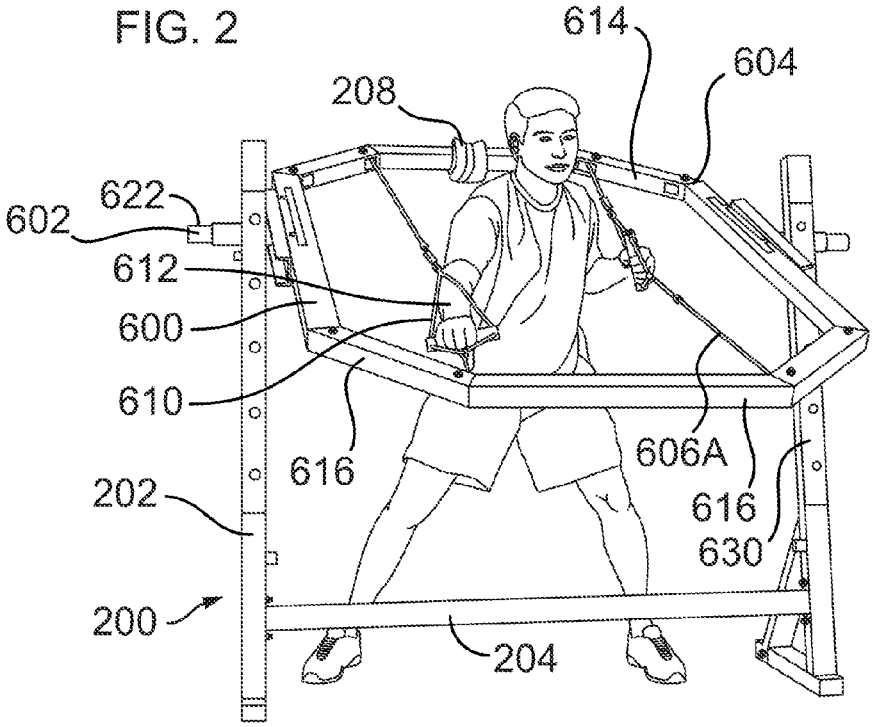

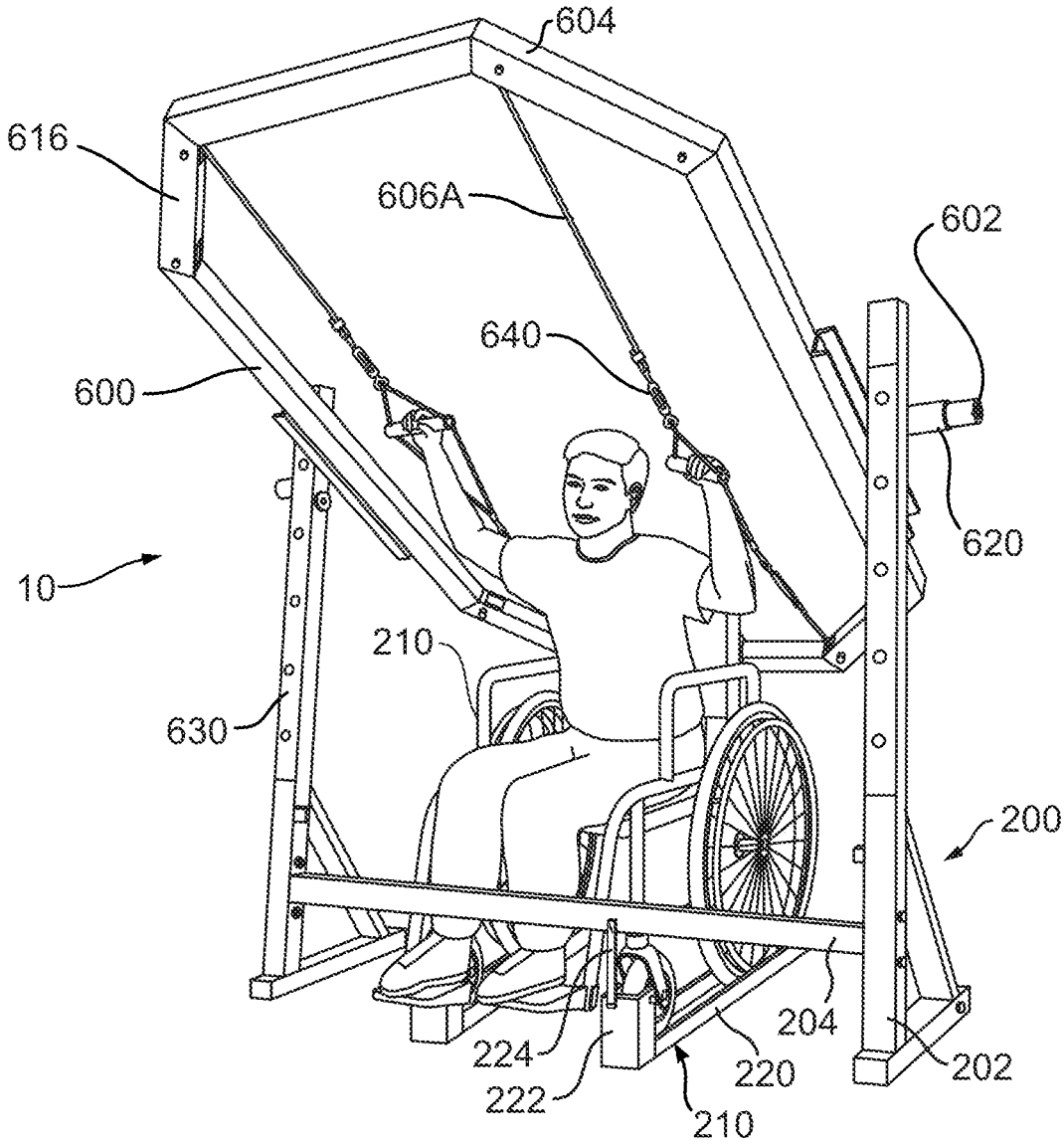
FIG. 2A
FIG. 2B
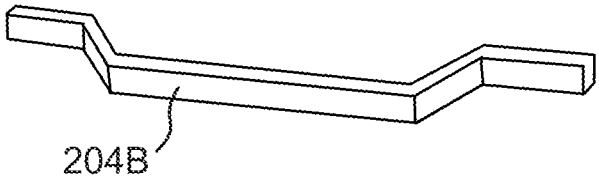

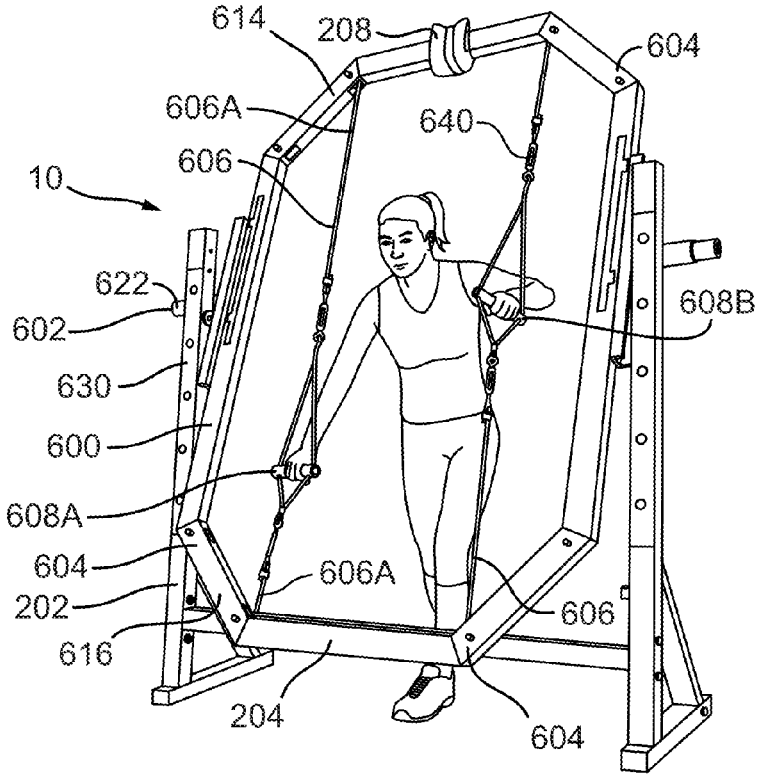
FIG. 3
FIG. 4
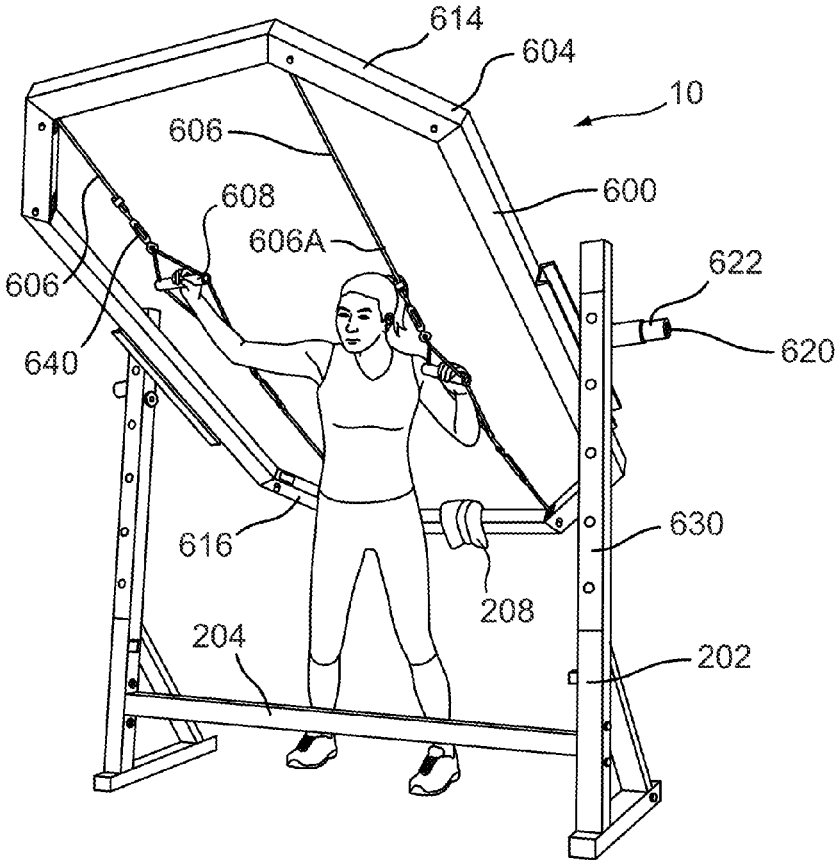

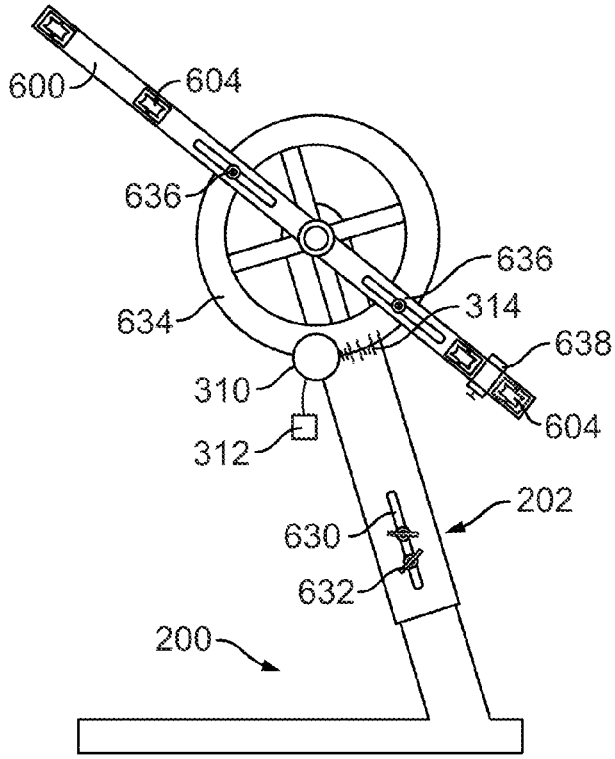
FIG. 5
FIG. 6A
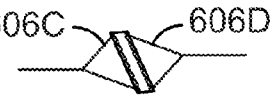
FIG. 6
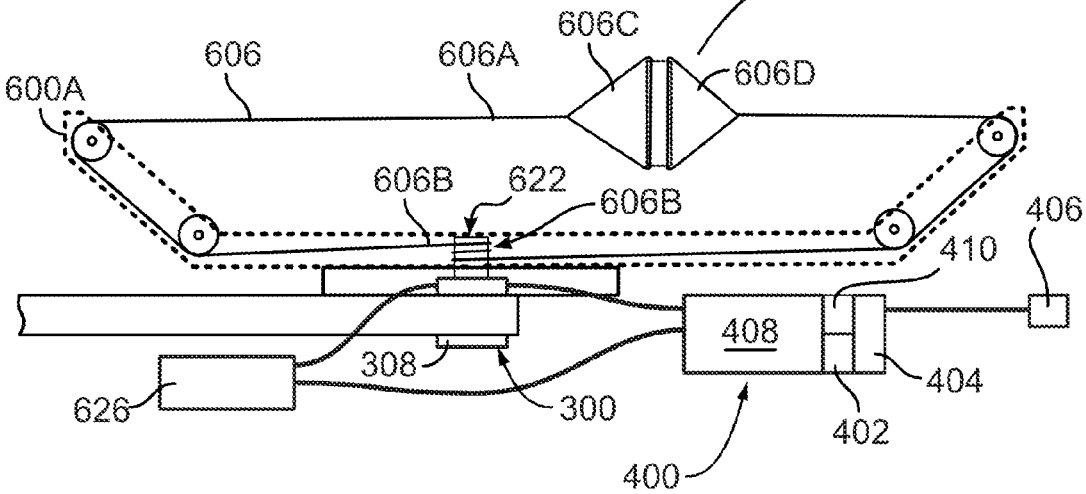

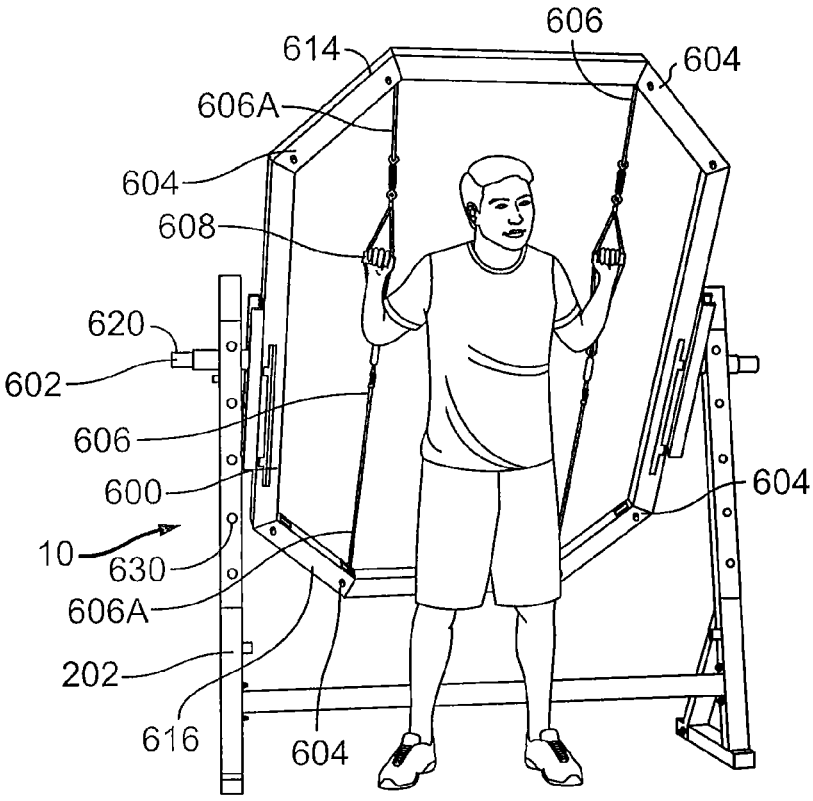
FIG. 10
FIG. 11
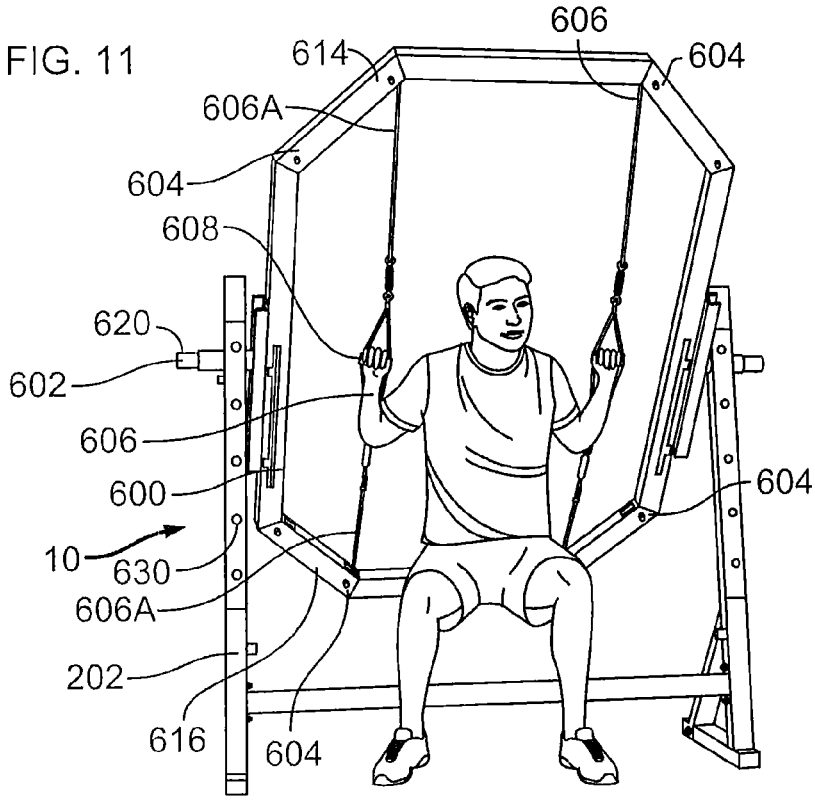

EXERCISE DEVICE AND METHOD

CROSS REFERENCE TO RELATED APPLICATIONS

This invention claims the benefit of related U.S. Provisional Application Ser. No. 61/252,303, filed Oct. 16, 2009, the contents of which are incorporated herein by reference.

FIELD OF THE INVENTION

The present invention relates to a device and method for improving strength and flexibility of the body, and particularly the torso and upper body.

BACKGROUND OF THE INVENTION

An exercise device for the upper body is disclosed in U.S. Pat. No. 4,836,535 to Pearson, in which a rigid, upright, free standing frame includes a pair of rigid, spaced apart, sides which dynamically mount a weight bar assembly which extends horizontally therebetween. A user can exercise by concurrently performing hand/arm movements and hand/wrist rotation while the stressed weight bar is manipulated. Rotatable sprockets are associated with the top and bottom of the machine frame. A chain entrained about the upper and lower sprockets synchronizes the weight bar assembly and enables it to be stressed when moved either upwardly or downwardly.

U.S. Pat. No. 5,040,785 to Charnitski discloses climbing exercise machine which has hand grips and foot pedals mounted to reciprocating separate sliding trucks which move within a track structure, wherein the sliding trucks are connected to each other by chains for mechanically providing coordinated leg and arm movements that simulate a vertical climbing action in a "homolateral pattern" and a "cross crawl pattern".

An exercise equipment for use by people in wheelchairs is disclosed in U.S. Pat. No. 5,044,629 to Ryan et al., which has a stationary frame within which a user can locate their wheelchair, including an attachment structure for securing the lower body of the user to the chair. A guide frame pivotally secured to the stationary frame is adjustable in its angle of inclination, which angle defines the plane of displacement in which weight-lifting exercise is performed by the user. A load bar is secured to the guide frame, for displacement therealong by the user, in carrying out their selected exercise. The load bar is connected by its ends in load transfer relation with two sets of selectively adjustable weights.

In U.S. Patent Publication 2008/0058175 to Gautier, a multi-axes exercise machine for strengthening muscles surrounding shoulder joint of a user allows the user a range of motions about lines of motion perpendicular to an arc of circumduction of the shoulder joints. A pair of handholds is suspended from an arcuate guide plate, which extends above a user station. By moving the point of securing the handholds along the length of the arcuate guide plate, the user can re-position the upper ends of the handholds from a location above the user station to a position behind the user station. At all times, the axes of rotation of the handholds are parallel to each other and extend along a plane that contains the axis of circumduction of the user's shoulders. A centerline of each handhold passes through the center of the corresponding glenohumeral joint of the user during the exercise.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 depicts an exercise device in accordance with the invention, in use by a user;

FIG. 2 depicts the device of FIG. 1, pivoted to a different exercise position;

FIG. 2A illustrates an alternative embodiment of the device of FIG. 1, configured to admit a wheelchair and user within the device;

FIG. 2B illustrates a brace of an alternative embodiment of the device of FIG. 1;

FIG. 3 depicts the exercise device of FIG. 1, with a user of different height, and pivoted to a different exercise position;

FIG. 4 depicts the exercise device of FIG. 3, pivoted to a different exercise position;

FIG. 5 illustrates an alternative embodiment of an exercise device in accordance with the invention, including means to rotate a position of the device;

FIG. 6 illustrates a further embodiment of an exercise device in accordance with the invention, illustrating a single sided exercise frame and resistance means;

FIG. 6A illustrates an angularly disposed grip in accordance with the invention;

FIG. 10 illustrates a first position of an exercise performed with the device of FIG. 1; and FIG. 11 illustrates a second position of the exercise illustrated in FIG. 10.

SUMMARY OF THE INVENTION

Figure 7:
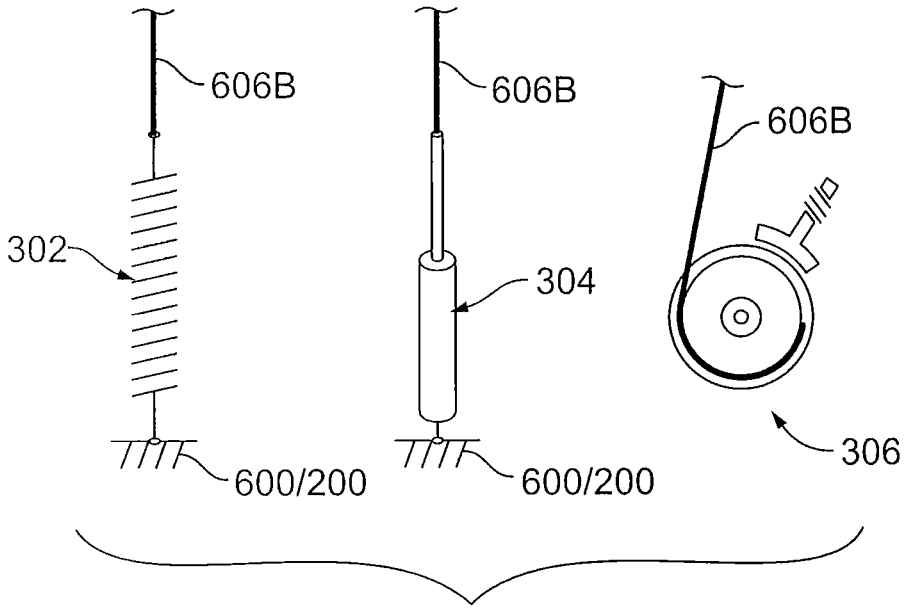
FIG. 7 illustrates alternative resistance means, in accordance with the invention.

In accordance with the invention, an apparatus for therapy for a patient, comprises a loop of bendable material; a handgrip positioned at a location along said loop; a base; a frame operative to slidingly support said loop to enable reversible rotation of said loop from a first position to a second position by movement of said handgrip, said frame rotatably supported upon said base, whereby an angular displacement of said loop with respect to said base is enabled by rotating said frame upon said base; and means associated with said loop to resist rotation of said loop from said first position to said second position; whereby therapy is obtained for the patient by rotating said frame to a desired angle and moving said handgrip by said patient between said first position and said second position, wherein different rotational angles of said frame produce a different therapeutic effect.

Further in accordance with the invention, two of said apparatus are provided, a first apparatus operable by the left hand of the body, and a second apparatus disposed proximate said first apparatus and operable by the right hand of the body at the same time as said first apparatus is operated by the left hand of the body.

In further embodiments of the invention, said handgrip of said first apparatus is movable in either the same direction or a different direction as said handgrip of said second apparatus, according to the therapeutic needs of the patient; said first apparatus and said second apparatus are connected therebetween by said frame; said first apparatus and said second apparatus are connected therebetween by at least one cross-member extending between said first apparatus and said second apparatus; said resistance means to resist rotation is selected from the group consisting of: electromagnetically controlled spool, spring, brake, pneumatic device, hydraulic device, frictional engagement device, and computer controlled actuator; one or more sensors operative to measure biometric parameters; and a computer is used to change a resistance of said means to resist rotation, based upon said measured biometric parameters.

In another embodiment of the invention, an apparatus for therapeutically stretching or exercising soft tissue of a body, comprises a loop of bendable material; a handgrip positioned at a location along said loop; a base; a frame operative to slidingly support said loop to enable reversible rotation of said loop from a first position to a second position by movement of said handgrip, said frame including an elongated joining member rotatably connected to said base and defining a longitudinal axis perpendicular to an axis of rotation, a first arm connected to a first end of said joining member and extending in a first direction radially away from said longitudinal axis of said joining member, a second arm connected to a second end of said joining member and extending in said first direction, said first and second arms operative to extend said loop in said first direction, whereby an angular displacement of said loop with respect to said base is enabled by rotating said frame upon said base, means associated with said loop to resist rotation of said loop from said first position to said second position; whereby therapy is obtained for the patient by rotating said frame to a desired angle and moving said handgrip by said patient between said first position and said second position, wherein different rotational angles of said frame produce a different therapeutic effect.

In further embodiments, two of said apparatus are provided, a first apparatus operable by the left hand of the body, and a second apparatus disposed proximate said first apparatus and operable by the right hand of the body at the same time as said first apparatus is operated by the left hand of the body; said handgrip of said first apparatus is movable in either the same direction or a different direction as said handgrip of said second apparatus, according to the therapeutic needs of the patient; said first apparatus and said second apparatus are connected therebetween by at least one cross member extending between an end of said first or second arm of said first apparatus and an end of said first or second arm of said second apparatus; the bendable member is selected from the group consisting of tape, chain, cable, and rope; said loop is slidingly supported by a member of the group consisting of: wheel, sheave, sprocket, v-shaped pulley, and low-friction block; means to tighten said loop; means to tighten include a turnbuckle; and said handgrip includes a loop of material extending from said loop of bendable material.

In yet another embodiment of the invention, an apparatus for exercising a body, comprises a handle graspable by a hand of the body; a forward flexible connector connected to said handle and extending away from said handle in a direction forwards of said handle and thence to a lateral end at a point lateral to said handle; a backward flexible connector connected to said handle and extending away from said handle in a direction backwards of said handle and thence to a lateral end at a point lateral to said handle; a front frame extension extending from a lateral end disposed at a point lateral to said handle to a point forward of said handle, and having means for guiding motion of said forward flexible connector from a point forward and away from said handle to a point lateral to said handle; a back frame extension extending from a lateral end disposed at a point lateral to said handle to a point backward of said handle, and having means for guiding motion of said backward flexible connector from a point backward and away from said handle to a point lateral to said handle; a support frame disposed at a point lateral to said handle and fixed relative to a floor upon which the body is supported; a pivoting member pivotally connected to said support frame and connected to said back frame lateral end and said front frame lateral end, whereby said front frame and said back frame are thus pivotally connected to said support frame; means to secure said pivoting member in a pivoted position; and resistance means connected to said forward and or rearward flexible connector operative to apply a tension to said forward or rearward flexible connector, resisting movement of said forward or rearward flexible cable when said forward or rearward flexible connector is pulled; whereby when a hand of the body grasps said handle and moves said handle in a forwards or rearwards direction, a resistance to the movement is transferred to tissue of the body, thereby conferring a therapeutic benefit to the tissue and the body; and whereby said pivoting member may be pivoted from a first position to a second position, whereupon resistance to movement of said handle is transferred to the body in a different way, conferring a changed therapeutic benefit to the tissue of the body.

In alternative embodiments, two of said apparatus are provided, a first apparatus operable by the left hand of the body, and a second apparatus disposed proximate said first apparatus and operable by the right hand of the body at the same time as said first apparatus is operated by the left hand of the body; said resistance means is provided separately for each of said forward and rearward flexible connectors.

DETAILED DESCRIPTION OF THE INVENTION

The invention enables exercise of the upper body without limiting movement to circumduction, or a linear path. Moreover, by allowing a wider range of motion, the invention strengthens muscles throughout the body as the entire body maintains stability while achieving the intended movements. The invention enables the direction of motion to pass through a wide variety of planes, enabling a focus on specific areas of body tissue requiring therapy.

The shoulder allows a great deal of arm motion, including 180 degrees of abduction and forward flexion, and 360 degrees of circumduction. The bones of the shoulder, including the humerus (upper arm), clavicle (collarbone), and scapula (shoulder blade), are held together throughout this range of motion with soft tissue, including muscles and tendons. Due to, for example, injury, surgery, or lack of use, an individual's desired range of motion or strength may not be adequate. For such an individual, the soft tissue must be stretched and/or strengthened to restore or improve functionality. Use of the device and methods of the invention promotes such stretching and strengthening, which can lead to a performance of the shoulder and upper body that is desired by the user.

To restore range of motion (ROM) and increase strength, it is advantageous to exercise the upper body and shoulder (glenohumerial joint) in flexion and extension (e.g. the humerus moving forward and returning), abduction and adduction (e.g. the humerus moving sideways/laterally and returning), and rotation (the humerus rotating on its long axis in either direction).

A system 10 in accordance with the invention includes a pivot frame 600 rotatably mounted to a base support 200 along a pivot axis 620. In one embodiment of the invention, a pivot brace 602 forms a rotatable connection between pivot frame 600, and base support 200, and pivot frame 600 is connected thereto. Pivot brace 602 advantageously may be angled 360 degrees, although a lesser arc remains advantageous. In another embodiment of the invention, pivot frame 600 is rotatably mounted to frame 600 using other means known in the art, for example bearings and a race, associated with pivot frame 600 and base support 200, respectively. In the embodiment of FIGS. 1-2, pivot brace 602 is affixed to pivot frame 600, rotatably received within base support 200. Alternatively, pivot brace 602 may be affixed to base support 200, rotatably received by pivot frame 600, using methods known in the art.

Pivot frame 600 is formed with two pivot frame ends 614, 616, which are disposed at an angle with respect to a location of pivot brace 602. In this manner, a user may more easily position a portion of his body between ends 614, 616, and use device 10 while avoiding contact with a portion of pivot frame 600. Pivot ends 614, 616 of pivot frames 600 disposed on opposite sides of device 10 may be joined together to form a shaped structure, for example a rectangle, octagon, or oval.

Figure 8:
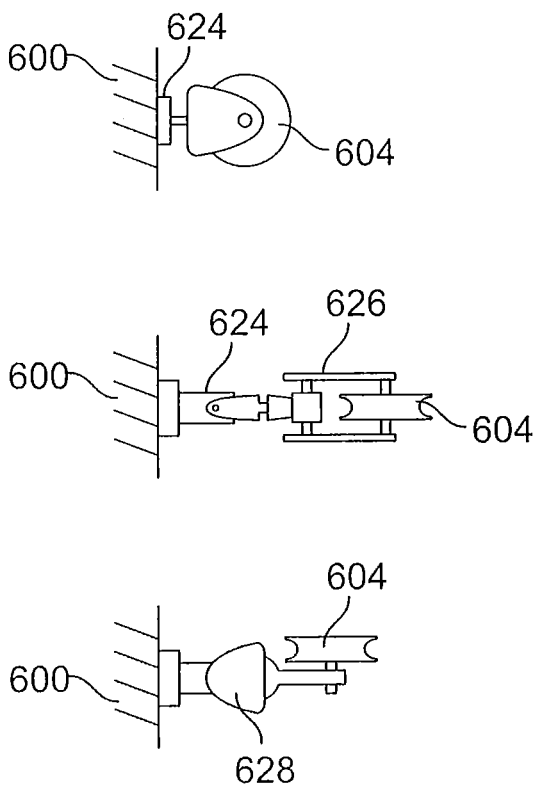
FIG. 8 illustrates alternative means for directionally aligning a cable, in accordance with the invention.

Pivot frame 600 includes a plurality of pulley sheaves or wheels 604 operative to transmit energy through one or more cables 606, in the form of power, torque, and speed, across their respective axes, the energy provided by a user of the machine, typically a human, although other species of animal may benefit from use of device 10 of the invention. Alternatively, wheels 604 may have the form of fixed bearing surfaces, sufficiently lubricious or of low friction, to support and enable smooth travel of cable 606 thereover. In FIGS. 1-4, the lubricious bearing surfaces or pulley wheels 604 are disposed within pivot frame 600, and are not directly visible, although they are illustrated in FIGS. 5-6 and 8, for example.

While a cable 606 is described, it should be understood that the invention contemplates the use of elongated flexible or bendable connector such as may be fabricated from natural, synthetic, or metallic materials, including a fiber in the form of a braided or twisted rope, a band, a shaped band, a chain, or any other type of flexible force transmitting medium, together with a compatible means for changing an angular direction of movement of the transmitting medium, such as wheel 604, or a sprocket, low friction block, v-shaped pulley, or the like.

Pivot frame 600 and support base 200, and connected elements of the invention, may be fabricated from a wide variety of materials, selectable by one skilled in the art. For example, aluminum is advantageous for its strength and light weight, although other metals may be used. Alternatively, plastics, or hybrids or composites, such as carbon fiber or sandwiched materials, may be advantageously used, provided they have the requisite strength.

One or more handles or grips 608, each grasped by the hand of a user, are connected to proximal portions 606A of cable 606 which extends in substantially opposite directions from grip 608. Tightening means 640, such as a turnbuckle as shown, may advantageously be positioned in the area of proximal portions 606A, whereby a user may ensure a desired tension in cable 606. Tightener or tightening means 640 may be positioned at other locations, for example an opposite end, of cable 606, and other tighteners may be used, as would be understood by one skilled in the art. In an embodiment of the invention, a gap 610 is formed by routing cable 606 through grip 608, thereby forming a triangular section 612 into which the hand of the user may pass, during operation of the device 10. An advantage of this embodiment is that grip 608 may be slid over each respective cable portions 606C, 606D to lie at an angle with respect to a direction of cable travel, as may be seen in FIG. 6A. Accordingly, the natural grasping angle of a users hand may be achieved, increasing comfort and reducing the possibility of injury or fatigue, including repetitive motion injury. Portions of cable 606 pass from grip 608 to respective ends 614, 616 of pivot frame 600, passing over wheels 604, and connecting to a spool 622 rotatably connected to base support 200 proximate pivot brace 602, at cable distal end 606B. Cable 606 may connect or wind onto sprocket or spool 622 at one or more locations, or cable 606 may be formed in a continuous length that frictionally engages spool via one or more turns about the circumference of spool 622. In one embodiment of the invention, the rotational axis of spool 622 is advantageously coaxial with the rotational axis of pivot brace 602, although this is not necessary in order to carry out the invention. In another embodiment, spool 622 has the form of a cam, enabling variable resistance to movement of cable 606.

It is an advantage of the invention to provide a flexible connector connected to grip 608, extending in both rearwards and forwards directions, in contrast to a relatively inflexible rod, bar, or shaft. More particularly, living limbs do not move through precise linear or arcuate paths. Natural geometry is imperfect, and wear to the joints, bone growths, and tissue damage or deformation lead to movements which are unpredictable to varying extents. However, in accordance with the invention, as cable 606 is flexible, it is more accommodating to variations in the path of movement fore and aft, as the user exercises. This helps to reduce fatigue, discomfort, or pain, as well as reduces the potential for harm to the limb or other body portions engaged in movement.

As grip 608 is advanced by the user in a first direction, a portion of cable 606 passes over at least one wheel 604, passing to thence to spool 622, the latter connected to resistance means 300. It should be understood that alternatively, cable 606 may engage resistor or resistance means 300 at any point along a path between grip 608 and fixed portions of device 10, as known in the art. For example, with reference to FIG. 7, an end of a spring 302, or a hydraulic or pneumatic device 304, or brake or frictional engagement device 306 may be attached to pivot frame 600, or base support 200, and cable 606 may then be attached to another end. Any of the foregoing resistors may be controlled by a computer, through various actuators as would be understood by one skilled in the art.

Further, cable 606 may be routed to pass over slide blocks or pulleys (not shown), passing through pivot axis 620, or changing a direction at or near pivot axis 620, for example to pass to upright support 202 of base support 200. Thus, resistance means 300 may be mounted laterally with respect to the frame, transversely, or at any desired angular location and position.

Resistance means 300, in the embodiment shown, for example, in FIG. 6, comprises a housing 308 connected to pivot frame 600 or base support 200, operable to rotatably receive spool 622, and to impose a resistance to the free rotation of spool 622. In one embodiment, an electromagnetic interaction between spool 622 and resistance means 300 includes a coil (not shown) mounted on either spool 622 or resistance means 300, and a corresponding ferrous, magnetized, or magnetizable material on the other corresponding part. Alternative embodiments for electrically creating resistance between a moving and stationary part may be used, as known in the art. In one embodiment, a current provided by a power source 626 is applied to the coil to create a resistance. It accordingly becomes possible, as an option, to generate and store electrical energy, as a user moves grips 608. This stored energy can be used to create a resistance, or alternately, to power a control assembly 400 or other device.

In an embodiment of the invention, control assembly 400 includes one or more display devices 402, for example an LCD display, and one or more user input devices 404, for example a keypad for entering biometric information, or a desired exercise program selection. Control assembly 400 is connected to resistance means 300, and is operable to change a resistance imposed thereby over time, based upon user input and or programmed instructions, for example by changing a current applied to, or consumable by, resistance means 300. Alternatively, control assembly 400 may directly control power source 626. In one embodiment, control assembly 400 includes computer central processing unit (CPU) 408. Other electronic, mechanical, or electrical auxiliary control means 410 may be included within control assembly 400, cooperative with CPU 408, or operative to independently control power source 626 directly. Additionally, one or more sensors 406, for measuring user biometric parameters, such as heart rate, breathing rate, or blood oxygenation, or for measuring one or more operating parameters of device 10, including a rate of movement of cable 606, angle of pivot frame 600, or a position of a user, may be connected to computer 400. Data from sensors 406 may be used to calculate a desired resistance, determine work performed by a user, and to display sensed and calculated information to a user, using display device 402. Caloric expenditure, rates of exercise, interval exercise parameters, and other exercise parameters known in the art may be calculated, controlled, and presented to a user by control assembly 400.

Resistance means may additionally be configured to provide a non-linear resistance, for example an eccentric or non-linear resistance effect, by varying a resistive force throughout a stroke, using CPU 408 to control resistance means 300, which may include a high torque motor under computer control, or using mechanical means as would be understood by one skilled in the art. In one embodiment, resistance corresponds to a rate of curvature of an ellipse. In a computer implement method, feedback sensors may be employed to measure, for example, a displacement of the stroke, to thereby calculate a desired resistance at a predetermined point along a stroke. For example, spool 622 may be provided with a non-circular shape, and enlarged or provided with gear reduction, if needed, to provide a desired progressive resistance within a stroke.

In one embodiment, shown for example in FIGS. 1-4, pivot frame 600 forms an enclosed ring encircling at least a portion of a user, and includes two grips 608, cables 606, and pivot braces 602, to accommodate the bilateral symmetry of a user. Cables 606 may be routed within pivot frame 600, so that movement of one grip 608 causes a corresponding movement in another grip 608. For example, as one arm travels forwards, the other travels backwards, particularly benefiting the oblique muscles of the torso. In this embodiment, a single resistance means 300 may be employed. Alternatively, cables 606 are separately movable, each grip connected to a separate resistance means 300.

In an alternative embodiment, shown in FIG. 6, pivot frame 600 is formed in two disconnected or disconnectable portions 600A and 600B (the latter not shown, but a mirror image of 600A, shown in FIG. 6), whereby each pivot frame portion 600A or 600B may be angled independently of the other pivot frame portion 600A or 600B, enabling each half of the upper body to be moved through a different path. This may be advantageous, for example, where there is a limited range of motion for one half of the body, or for training for specialized equipment operation. In another embodiment, the separate pivot frame portions 600A and 600B are interconnected, for example with a latch or mechanical brace (not shown), whereby angularly aligned symmetric motion may be restored.

With reference to the figures, and in particular FIGS. 3-4, it can be seen that pivot frame 600 may be angled with respect to the ground or floor, or the vertical axis of a users body. In this manner, a user may focus exercise on soft tissue associated with a particular disposition of the bones of the upper body. For example, particular ligaments or muscles associated with an angular location of the rotator cuff may be targeted for stretching or strengthening, or other form of therapeutic exercise associated with a movement thereof, for example increasing blood flow. By altering the angle of pivot frame, it is possible to progressively exercise soft tissue throughout the complete circumference of the rotator cuff. Changing an angle of pivot frame 600 may further be carried out to selectively target for exercise the trapezious, rhomboids, deltoids, latissimus dorsi, pectorals, rotators, biceps, triceps, and forearm muscles.

To operate device 10, a user places a portion of his or her body within, proximate, or adjacent to at least one pivot frame portion 600A, 600B, or within the encircling radius of a unified bilateral pivot frame 600. Typically, it is the upper body that is thus positioned; however, it should be understood that other uses of device 10 in accordance with the invention are contemplated, including engaging grips 608 with the toes, feet, ankles, knees, hips, elbows, wrists, or other portions of the body. At least one grip 608 is grasped or engaged by the body, and is moved along in a direction along a line roughly or substantially corresponding to a line formed by the entry and exit angle of cable 606 in attachment to grip 608. It is an advantage of the invention, however, that some deviation from the precise line or path of cable 106 is possible. In this manner, a user must engage other tissues of the body in an effort to maintain a stability of the body, and to maintain motion along a desired trajectory.

When the hands of the user engage grips 608, the arms are moved to and fro, advantageously through an arc of up to about 180 degrees, although lesser or greater arcs remain therapeutically beneficial. In one application of device 10, pivot axis 620 is aligned with the shoulders of the user, although other alignments are therapeutically beneficial. As a user's arm movements are eccentrically biased anteriorly, with the degree varying among individual users, cable 606 length, and grip 608 position, are configured and positioned within pivot frame 600 to enable and facilitate this anterior bias. Accordingly, pivot brace 602 may be mounted in a more posterior location along pivot frame 600, so that pivot frame 600 pivots eccentrically.

Where two pivot frame portions 600A and 600B are provided, associated grips 608 may each be moved in the same, or different directions. For example, and with reference to FIGS. 10-11, hands of a user may be maintained at a fixed location with respect to the body, and the user's legs may be flexed and extended, causing a corresponding movement of grips 608A, 608B. In the example shown in FIGS. 10-11, the user is performing an axial loading exercise similar to that known as "squats", typically performed with squared shoulders. In this instance, however, device 10 is applying additional resistive force to the user's body. In this manner, exercise to the legs is increased, and other portions of the body, including the arms and the core or body trunk, are additional simultaneously exercised together with the legs. Under conditions of microgravity, eccentric loading of the quadriceps femoris and axial loading of the spine could be provided using a high torque motor and computer algorithm to simulate a vertical jump and landing under conditions of variable amounts of gravitational force.

Accordingly, and with reference to FIG. 8, wheel 604 may be mounted to pivot frame 600 using a pivot 624, or multiple pivots 624, 626, or a polyaxial connection 628, facilitating a wider variety of trajectories for cable 606 and grip 608. An extent of possible deviation is changeable by adjusting a tension of cable 606; a tighter cable 606 enables less deviation from a linear trajectory, and imposes less demand on the user's body to maintain stability, and a looser cable 606 enables more deviation from a linear trajectory, and imposes more demand on the user's body to maintain stability. A requirement to carry out steady, linear motion of grip 608 against a resistance may this involve muscles beyond the upper body, including the lower back, hips, legs, ankles, and feet. Additionally, less stability provides an opportunity for greater work for the upper body, as well.

To enhance comfort and safety of a user, a pad or soft surface 208, shown in FIG. 1, may be provided at points upon device 10 upon which a user may inadvertently contact. In this manner, a user's body may be positioned within device 10 without contacting base support 200 or connecting brace 204.

With reference to FIG. 2A, a wheelchair or other accessibility device or apparatus 210, may be positioned in relation to device 10, for therapeutically beneficial use of device 10 by a user. Means for securing apparatus 210 may include, for example, ramps 220 and or clamps 222. Connector 224, or other attachment means, may be provided in association with connecting brace 204 or base support 200, to additionally secure an apparatus 210, associated ramp 220, or clamp 222, in a desired location relative to device 10. Other attachment means may be employed to affix an apparatus 210 relative to device 10, as would be understood by one skilled in the art. Such means are advantageously removed or stowed to avoid interference with a user when an accessibility apparatus 210 is not being employed or secured with respect to device 10. Although not necessary to carry out the invention, when using a wheelchair as accessibility device 210, it may be advantageous to use a wheelchair without armrests, or with removable armrests, to ensure unrestricted motion of the user's arms during exercise. In FIG. 2B, it can be seen that frame 600 has been pivoted to position grips 608 within reach of a user.

In an alternative embodiment of the invention, connecting brace 204B, shown in FIG. 2B, which is positioned to join symmetrical halves of base support 200, may be shaped to extend a sufficient distance forwards with respect to an entry location, to facilitate entry within device 10, by the user or an apparatus 210. One or more frame components such as brace 204, 204B may be provided in replaceable forms, so that device 10 may be configured for an installation site, or the particular needs of the one or more users.

In a further alternative, apparatus 210 is a fixed chair, stool, or rotating stool or seat, and a user is seated thereupon, during exercise. In light of the foregoing, it can be see that a device in accordance with the invention may be beneficially used by a user who is seated in a wheelchair or other seating device, or a user who is standing, requiring only a height adjustment of upright support 202, as would be carried out, for example, for users having different heights. An angular orientation of pivot frame 600 is then carried out for targeting particular muscle groups, as otherwise outlined herein.

As shown in FIG. 5, base support 200 may be provided with a height adjustment mechanism, such as adjustment slot 630, to change a height of pivot frame 600 to suit users of different heights, or users seated or standing. Handles 632 may be associated with height adjustment mechanism 630 to facilitate a height adjustment without tools. FIG. 5 further illustrates an angular disposition of upright support 202, facilitating entry of a user within an interior formed by pivot frame 600. Further illustrated is a circular brace 634, which may be included to provide additional lateral stiffness for pivot frame 600, and may enable fore and aft movement, or anterior/posterior movement thereof with respect to a user, through a positional change in displacement adjustment mechanism 636. In use, it is advantageous for pivot frame 600 to be eccentrically, or offset, mounted at pivot axis 620. This provides a greater or lesser space within pivot frame 600 for optimal positioning and movement of a user, depending on the user's size, reach, and height. Providing additional space may advantageously facilitate positioning a user a sufficient distance from base support 200 and connecting brace 204.

A suitable counterweight 638 may be provided connected to pivot frame 600, to improve a balance for movement of pivot frame 600 about pivot axis 620, so that a user may more easily turn pivot frame 600 about pivot axis 620. Counterweight 638 may be slideably or releasably fastened or mounted to pivot brace 602, so that a position of counterweight 638 may be quickly changed if, for example, displacement adjustment mechanism 636 is used to change an offset of pivot frame 600 with respect to pivot axis 620.

In a further embodiment of the invention, resistance means 300 may be driven by control assembly 400, to cause a movement of a user engaged with grips 608. This may be advantageous, for example, as therapy for injury or paralysis. Accordingly, one or more portions of the user's body may be stabilized, for example secured to a chair, rotating stool, or other device, so that a force applied by device 10 may operate to move only a desired portion of a user's body. A rotating stool (not shown) may be provided with resistance to rotation, whereby additional therapeutic benefit may be obtained.

Device 10 is thus operable to exercise many of the muscles of the arms and torso during a single exercise session, without a requirement to change workout stations, or to engage a variety of alternate exercise therapy devices. Device 10 is advantageously used in a formal exercise facility, rehabilitation facility, or in a home or business setting.

Resistance means 300 may be selected from a variety of resilient, resistant, or controllable devices as disclosed herein, or as known in the art, to present a desired resistance profile during use. For example, it may be desired to enable an initial movement with a lower resistance, then a progressively higher rate of resistance. This may be achieved with a progressive spring. Alternatively, control assembly 400 may precisely control not only a program of exercise, but the resistance profile of each movement stroke. A resistance beneficial for a competition body builder would typically be much higher than a person recovering from injury or illness. Accordingly, resistance means 300 advantageously include replaceable or adjustable springs, weights, or other mechanical resistance means. Control assembly 400 advantageously provides for the widest foreseeable range of resistance required for all users.

In one use of the invention, a user pushes one grip 608 and pulls another grip 608 in contra or opposing directions. In this manner, where the shoulders are free to move, the upper body may rotate relative to the lower body, providing exercise to the muscles of the arms, shoulders, abdomen, and back. Muscles particularly therapeutically benefited by this type of movement include the internal and external obliques, the transversus abdominus, the latissimus dorsi, and serratus.

In an alternative user of the invention, a user pushes and pulls both grips 608 in the same direction. This rowing type motion provides beneficial exercise similar to push-ups, benefiting, for example, the pectoralis and trapezious muscles.

By varying exercise between same and contra directional movement of grips 608, and by performing exercises at various angular dispositions of pivot frame 600, a user can exercise almost all of the muscles in the upper body and torso. By selecting a particular directional movement, or a particular range of angular displacement of pivot frame 600, a user may alternatively focus therapeutic exercise on a particular group of muscles. Of course, bones and soft tissues associated with the targeted muscle groups are also therapeutically exercised, stretched, and strengthened.

Additionally, it may be possible for a user to exercise in accordance with the invention either facing forwards, with pivot axis 620 ahead of the user, or facing backwards, with pivot axis 620 behind the user. A forward facing position is sometimes advantageous, however, due to the arms having a longer reach for most exercises when extended in front of the body. Accordingly, more room is provided within the offset or eccentrically disposed pivot frame 600 when the user is facing forwards, towards a direction of pivot axis 620.

Alternatively, a user may exercise with only a single side, grasping grip 608 with one or both hands. Accordingly, an embodiment of the invention may be constructed to be unilateral, for example to save space or reduce cost. Further, two unilateral devices may be joined or separated, as needed. A unilateral embodiment has, for example, only one pivot frame 600, pivot axis 620, grip 608, and resistance means 300. With either a unilateral or bilateral embodiment of the invention, a user may optionally operate the device with one or both hands, either in a forward, backwards, or sideways facing orientation, relative to a longitudinal axis of pivot frame 600.

In accordance with the invention, resistance may be varied between a left side of the body, and a right side of the body, for example to promote a balanced development or treatment of soft tissue or bone on each respective side of the body. Similarly, resistance may be varied between a forward stroke and a rearward stroke for each side of the body, again, for example, to target the development of different body tissue. Control assembly 400 may be used to sense a direction of cable 606 movement, and may then vary the resistance for each stroke direction. Alternatively, duplicate resistance means 300 may be employed, wherein separate resistance means 300 are provided for each length of cable extending forward and backward from grip 608.

In a further embodiment of the invention, a rotation drive means 310, provided with a rotation drive controller 312, controlled by control assembly 400, enables a change in angle of pivot frame 600 during exercise, or between discrete exercises. Alternatively, the rotation may be controlled by the user, using a manual adjustment possibly including a ratcheting mechanism, and advantageously including a readable scale 314. In this manner, the full range of motion, or portions of the range of motion of the upper body, can be exercised automatically or with precision, as best implements a therapeutic regimen.

In alternative embodiments of the invention, base support 200 may be connected to any surface of an exercise area, including the walls and ceiling. In one example, base support 200 may be connected to a surface of a craft operating in a microgravity, whereby a wide variety of exercises are made possible. In this embodiment, base support 200 is adapted to fasten to the wall using means known in the art, and in one embodiment of the invention upright supports 202 or other frame portion may hinge against a portion of base support 200 attached to the craft structure. Pivot frame 600 is inherently adapted to pivot and assume a desired angular displacement relative to base support 200. Accordingly, the entirety of device 10 may be flattened against a supporting surface of a craft, thereby saving space when not in use. In this embodiment, it is advantageous to provide the user with means to secure the user's feet to a surface, for example with hook and loop fasteners, or a shoe binding, wherein the surface may be common to base support 200, or may be positioned elsewhere. When positioned elsewhere, pivot frame 600 is adjusted to correlate a new reference position for the user's body, so that the desired soft tissues of the body may be stretched and strengthened, thereby also strengthening bones of the body, to thereby counteract any deleterious effects of weightlessness upon the user's body, over time.

The foregoing additionally applies to a location of normal gravity. Specifically, where the user is standing on a different surface than that to which base support 200 is attached, pivot frame 600 is rotated to reflect a desired angle with respect to the user's body. Where base support 200 is attached to a wall, means may be provided for changing a height of device 10 with respect to the floor, for example by including multiple mounting points, or a sliding track with pins or gears to maintain an elevation of device 10. When device 10 is attached to a ceiling, adjustment slot 630 may be used, although this may be adapted to be remotely adjusted, as would be understood to one skilled in the art. In this configuration, device 10 may hinged to fold flat against a ceiling of an exercise area, thus further saving space.

Computer System

Figure 9:
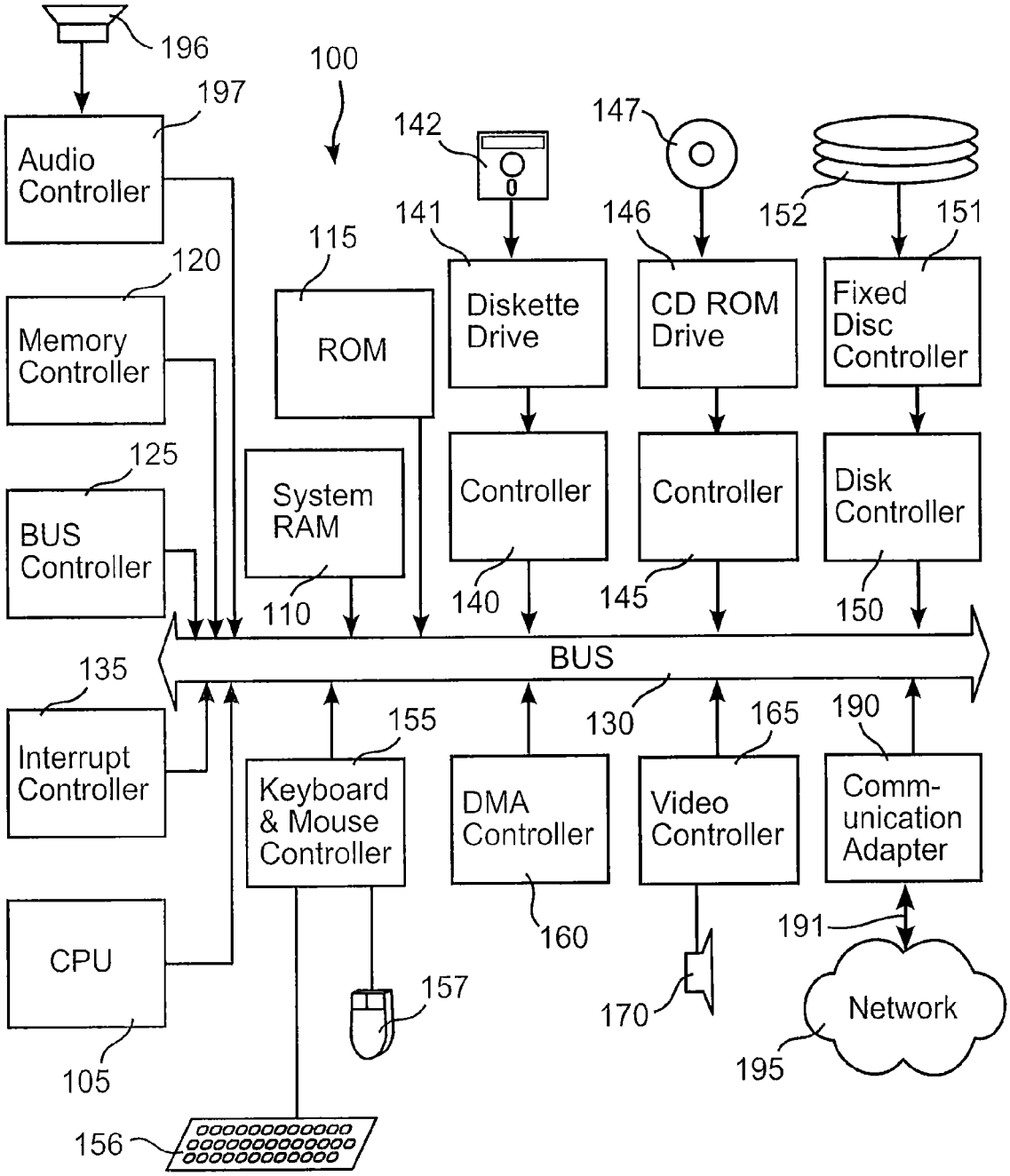
FIG. 9 illustrates a computing system upon which the invention may be implemented.

FIG. 9 illustrates the system architecture for a computer system 100 such as a server, work station or other processor on which the invention may be implemented. The exemplary computer system of FIG. 9 is for descriptive purposes only. Although the description may refer to terms commonly used in describing particular computer systems, the description and concepts equally apply to other systems, including systems having architectures dissimilar to FIG. 9.

Computer system 100 includes at least one central processing unit (CPU) 105, or server, which may be implemented with a conventional microprocessor, a random access memory (RAM) 110 for temporary storage of information, and a read only memory (ROM) 115 for permanent storage of information. A memory controller 120 is provided for controlling RAM 110.

A bus 130 interconnects the components of computer system 100. A bus controller 125 is provided for controlling bus 130. An interrupt controller 135 is used for receiving and processing various interrupt signals from the system components.

Mass storage may be provided by diskette 142, CD or DVD ROM 147, flash or rotating hard disk drive 152. Data and software, including software 400 of the invention, may be exchanged with computer system 100 via removable media such as diskette 142 and CD ROM 147. Diskette 142 is insertable into diskette drive 141 which is, in turn, connected to bus 130 by a controller 140. Similarly, CD ROM 147 is insertable into CD ROM drive 146 which is, in turn, connected to bus 130 by controller 145. Hard disk 152 is part of a fixed disk drive 151 which is connected to bus 130 by controller 150. It should be understood that other storage, peripheral, and computer processing means may be developed in the future, which may advantageously be used with the invention.

User input to computer system 100 may be provided by a number of devices. For example, a keyboard 156 and mouse 157 are connected to bus 130 by controller 155. An audio transducer 196, which may act as both a microphone and a speaker, is connected to bus 130 by audio controller 197, as illustrated. It will be obvious to those reasonably skilled in the art that other input devices, such as a pen and/or tablet, Personal Digital Assistant (PDA), mobile/cellular phone and other devices, may be connected to bus 130 and an appropriate controller and software, as required. DMA controller 160 is provided for performing direct memory access to RAM 110. A visual display is generated by video controller 165 which controls video display 170. Computer system 100 also includes a communications adapter 190 which allows the system to be interconnected to a local area network (LAN) or a wide area network (WAN), schematically illustrated by bus 191 and network 195.

Operation of computer system 100 is generally controlled and coordinated by operating system software, such as a Windows system, commercially available from Microsoft Corp., Redmond, Wash. The operating system controls allocation of system resources and performs tasks such as processing scheduling, memory management, networking, and I/O services, among other things. In particular, an operating system resident in system memory and running on CPU 105 coordinates the operation of the other elements of computer system 100. The present invention may be implemented with any number of commercially available operating systems.

One or more applications, such as an HTML page server, or a commercially available communication application, may execute under the control of the operating system, operable to convey information to a user.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. An apparatus for therapy for a patient, comprising:

a loop of bendable material;

a handgrip positioned at a location along said loop;

a base;

a frame operative to slidingly support said loop to enable reversible rotation of said loop from a first position to a second position by movement of said handgrip, said frame rotatably supported upon said base, whereby an angular displacement of said loop with respect to said base is enabled by rotating said frame upon said base; and a resistor associated with said loop and configured to resist rotation of said loop from said first position to said second position;

whereby therapy is obtained for the patient by rotating said frame to a desired angle and moving said handgrip by said patient between said first position and said second position, wherein different rotational angles of said frame produce a different therapeutic effect.

2. The apparatus of claim 1, wherein two of said apparatus are provided, a first apparatus operable by the left hand of the body, and a second apparatus disposed proximate said first apparatus and operable by the right hand of the body at the same time as said first apparatus is operated by the left hand of the body.

3. The apparatus of claim 2, wherein said handgrip of said first apparatus is movable in either the same direction or a different direction as said handgrip of said second apparatus, according to the therapeutic needs of the patient.

4. The apparatus of claim 2, wherein said first apparatus and said second apparatus are connected therebetween by said frame.

5. The apparatus of claim 2, wherein said first apparatus and said second apparatus are connected therebetween by at least one cross-member extending between said first apparatus and said second apparatus.

6. The apparatus of claim 1, wherein said resistor is selected from the group consisting of: electromagnetically controlled spool, spring, brake, pneumatic device, hydraulic device, frictional engagement device, and computer controlled actuator.

7. The apparatus of claim 1, further including one or more sensors operative to measure biometric parameters.

8. The apparatus of claim 7, wherein a computer is used to change a resistance of said resistor, based upon said measured biometric parameters.

9. An apparatus for therapeutically stretching or exercising soft tissue of a body, comprising:

a loop of bendable material;

a handgrip positioned at a location along said loop;

a base;

a frame operative to slidingly support said loop to enable reversible rotation of said loop from a first position to a second position by movement of said handgrip, said frame including an elongated joining member rotatably connected to said base and defining a longitudinal axis perpendicular to an axis of rotation, a first arm connected to a first end of said joining member and extending in a first direction radially away from said longitudinal axis of said joining member, a second arm connected to a second end of said joining member and extending in said first direction, said first and second arms operative to extend said loop in said first direction, whereby an angular displacement of said loop with respect to said base is enabled by rotating said frame upon said base, and a resistor associated with said loop and configured to resist rotation of said loop from said first position to said second position;

whereby therapy is obtained for the patient by rotating said frame to a desired angle and moving said handgrip by said patient between said first position and said second position, wherein different rotational angles of said frame produce a different therapeutic effect.

10. The apparatus of claim 9, wherein two of said apparatus are provided, a first apparatus operable by the left hand of the body, and a second apparatus disposed proximate said first apparatus and operable by the right hand of the body at the same time as said first apparatus is operated by the left hand of the body.

11. The apparatus of claim 10, wherein said handgrip of said first apparatus is movable in either the same direction or a different direction as said handgrip of said second apparatus, according to the therapeutic needs of the patient.

12. The apparatus of claim 10, wherein said first apparatus and said second apparatus are connected therebetween by at least one cross member extending between an end of said first or second arm of said first apparatus and an end of said first or second arm of said second apparatus.

13. The apparatus of claim 9, wherein the bendable material is selected from the group consisting of tape, chain, cable, and rope.

14. The apparatus of claim 9, wherein said loop is slidingly supported by a member of the group consisting of: wheel, sheave, sprocket, v-shaped pulley, and low-friction block.

15. The apparatus of claim 6, further including a tightener configured to tighten said loop.

16. The apparatus of claim 15, wherein said tightener is a turnbuckle.

17. The apparatus of claim 9, wherein said handgrip includes a loop of material extending from said loop of bendable material.

18. An apparatus for exercising a body, comprising:

a handle graspable by a hand of the body;

a forward flexible connector connected to said handle and extending away from said handle in a direction forwards of said handle and thence to a lateral end at a point lateral to said handle;

a backward flexible connector connected to said handle and extending away from said handle in a direction backwards of said handle and thence to a lateral end at a point lateral to said handle;

a front frame extension extending from a lateral end disposed at a point lateral to said handle to a point forward of said handle, and having supports configured to guide motion of said forward flexible connector from a point forward and away from said handle to a point lateral to said handle;

a back frame extension extending from a lateral end disposed at a point lateral to said handle to a point backward of said handle, and having supports configured to guide motion of said backward flexible connector from a point backward and away from said handle to a point lateral to said handle;

a support frame disposed at a point lateral to said handle and fixed relative to a floor upon which the body is supported;

a pivoting member pivotally connected to said support frame and connected to said back frame lateral end and said front frame lateral end, whereby said front frame and said back frame are thus pivotally connected to said support frame;

a clamp to secure said pivoting member in a pivoted position; and a resistor connected to said forward and or rearward flexible connector operative to apply a tension to said forward or rearward flexible connector, resisting movement of said forward or rearward flexible cable when said forward or rearward flexible connector is pulled;

whereby when a hand of the body grasps said handle and moves said handle in a forwards or rearwards direction, a resistance to the movement is transferred to tissue of the body, thereby conferring a therapeutic benefit to the tissue and the body; and whereby said pivoting member may be pivoted from a first position to a second position, whereupon resistance to movement of said handle is transferred to the body in a different way, conferring a changed therapeutic benefit to the tissue of the body.

19. The apparatus of claim 18, wherein two of said apparatus are provided, a first apparatus operable by the left hand of the body, and a second apparatus disposed proximate said first apparatus and operable by the right hand of the body at the same time as said first apparatus is operated by the left hand of the body.

20. The apparatus of claim 18, wherein said resistor is provided separately for each of said forward and rearward flexible connectors.

* * * * *